US009545556B2

(12) United States Patent
Mohammed

(10) Patent No.: US 9,545,556 B2
(45) Date of Patent: Jan. 17, 2017

(54) BASKETBALL TRAINING GLOVE

(71) Applicant: Caliph A. Mohammed, Scottsdale, AZ (US)

(72) Inventor: Caliph A. Mohammed, Scottsdale, AZ (US)

( * ) Notice: Subject to any disclaimer, the term of this patent is extended or adjusted under 35 U.S.C. 154(b) by 0 days.

(21) Appl. No.: 14/690,358

(22) Filed: Apr. 17, 2015

(65) Prior Publication Data

US 2016/0303465 A1 Oct. 20, 2016

(51) Int. Cl.
*A41D 19/00* (2006.01)
*A63B 71/14* (2006.01)

(52) U.S. Cl.
CPC ..... *A63B 71/148* (2013.01); *A63B 2243/0037* (2013.01)

(58) Field of Classification Search
CPC ..... A63B 71/148; A63B 2243/0037; A63B 71/141; A61F 5/0118; A61F 5/013; A61F 5/05866; A61F 5/05875; A41D 19/01
USPC ..... 2/21, 161, 161.1, 163, 159
See application file for complete search history.

(56) References Cited

U.S. PATENT DOCUMENTS

| | | | | |
|---|---|---|---|---|
| 3,581,312 | A * | 6/1971 | Nickels | A63B 71/148 2/159 |
| 4,565,195 | A * | 1/1986 | Eisenberg | 2/16 |
| 5,188,356 | A * | 2/1993 | Furr | A63B 69/0071 128/880 |
| 5,197,149 | A * | 3/1993 | Overton | 2/162 |
| 5,453,064 | A * | 9/1995 | Williams, Jr. | 482/47 |
| 5,758,365 | A * | 6/1998 | Steeley | 2/161.1 |
| 5,970,521 | A * | 10/1999 | Rabbeth | 2/161.1 |
| 7,437,776 | B1 | 10/2008 | Brown | |
| 7,856,670 | B1 * | 12/2010 | Hazuga et al. | 2/160 |
| 2004/0199978 | A1 * | 10/2004 | Cass | A41D 19/01564 2/161.3 |
| 2007/0028354 | A1 * | 2/2007 | Hochmuth | 2/161.1 |
| 2009/0318248 | A1 * | 12/2009 | Russotti | A63B 71/148 473/450 |

* cited by examiner

*Primary Examiner* — Clinton T Ostrup
*Assistant Examiner* — Abby Spatz
(74) *Attorney, Agent, or Firm* — Thomas W. Galvani, P.C.; Thomas W. Galvani

(57) ABSTRACT

A glove includes a glove body having a bottom, a top, a middle, and palmar and dorsal panels extending from the bottom to the middle. The glove also includes finger covers extending from the middle to the top, and a thumb stall. A wrist strap is carried on the bottom of the glove body, and a thumb strap is carried on the middle of the glove body. Finger straps are carried on the finger covers. Rigid elements are carried along each of the finger covers and prevent the fiver covers from flexing.

3 Claims, 7 Drawing Sheets

BASKETBALL TRAINING GLOVE

FIELD OF THE INVENTION

The present invention relates generally to sports equipment, and more particularly to gloves useful for basketball training.

BACKGROUND OF THE INVENTION

Sports training equipment has been used abundantly to help athletes improve the quality of their sporting play and experience. From golf putting alignment devices to weighted baseball bats, and from compression clothing to power-measuring bicycle pedals, there are a large number of devices which athletes can use to help them train, receive feedback about their performance, and help improve recovery between training.

Basketball is no exception. There are a wide variety of basketball training aids. For example, some aids help an athlete shoot the ball, some remind the athlete how to play defense, and some aid the athlete in performing a layup. Several types of devices have been developed to attempt to train an athlete on how to shoot a ball properly. These include devices for training both the shooting hand (the hand which holds and shoots the ball) and the guide hand (the hand which supports and guides the ball during shooting). Gloves for training the shooting hand may train the fingers to spread apart on the basketball, reduce lateral or rolling movement at the wrist, or point the fingers in a certain way after shooting. Gloves for training the guide hand include those which position the hand on the side of the ball, or prevent the athlete's forearm from bending away from his upper arm, or pull the thumb back toward the arm. Other basketball gloves prevent the athlete from "thumbing" or providing excessive rotation to the ball during the shot. In summary, there are many types of basketball training gloves.

Unfortunately, the known gloves fail to reinforce and train proper one-handed shooting technique. With proper shooting technique, a majority of support and power comes from the shooting hand, and the guide hand functions simply to stabilize the ball laterally. With proper shooting technique, the shooting must be under the ball, and the guide hand must be directed vertically on the side of the ball. However, most training aids, when attempting to correct one known issue, inadvertently create other problems. For instance, one training aid draws the thumb back from the hand in an attempt to prevent the athlete from thumbing the basketball. However, younger shooters, who have not yet developed the strength of older players, will compensate for the isolation of the thumb by cradling the basketball equally between both hands and will then heavily rely on shooting the ball with both hands and splaying their fingers during the shot, in order to apply power to the shot that would have otherwise been provided by the isolated thumb. Younger shooters will thus tend to rely too much on using the fingers of both hands to shoot when the thumb on the guide hand is drawn back in this fashion.

Heretofore, basketball training aids have been used with the hand which is being trained. In other words, if the shooting hand is being trained, the shooting hand is applied with a glove or other device. Similarly, if the guide hand is being trained, the guide hand is applied with a glove or other device. This narrowed focus has failed to meet the needs of actual athletes. There is no glove which properly trains the athlete in how the guide hand should engage the basketball itself, in cooperation with the shooting hand, to shoot the ball properly. An improved basketball training glove is needed.

SUMMARY OF THE INVENTION

A basketball training glove includes a glove body having a bottom, a top, a middle, and palmar and dorsal panels extending from the bottom to the middle. The glove also includes finger covers extending from the middle to the top, and a thumb stall. A wrist strap is carried on the bottom of the glove body, and a thumb strap is carried on the middle of the glove body. Finger straps are carried on the finger covers. Rigid elements are carried along each of the finger covers and prevent the finger covers from flexing.

BRIEF DESCRIPTION OF THE DRAWINGS

Referring to the drawings.

DETAILED DESCRIPTION

Figure 1A:
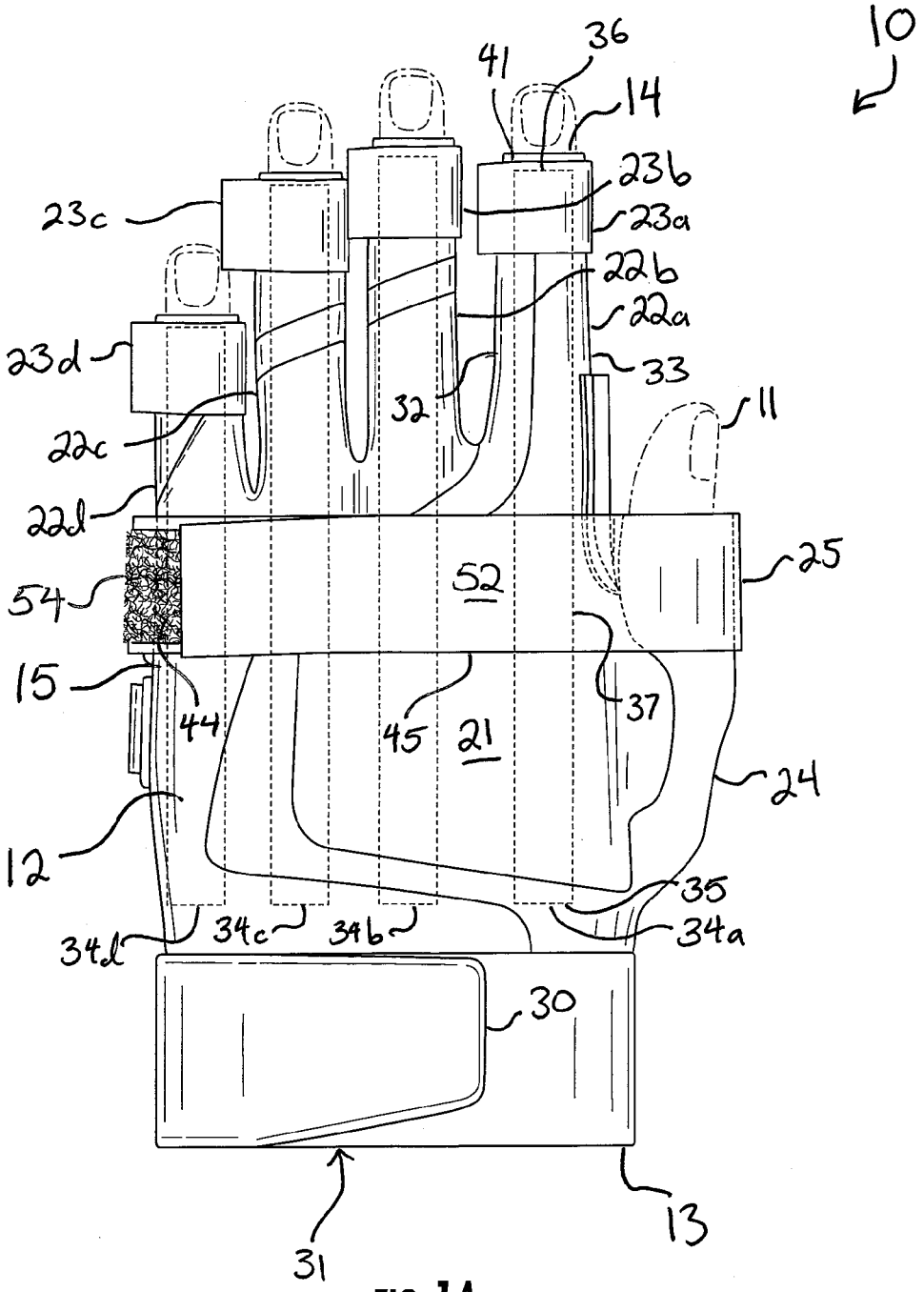
FIGS. 1A and 1B are front and rear elevation views, respectively, of a basketball training glove.
Figure 1B:
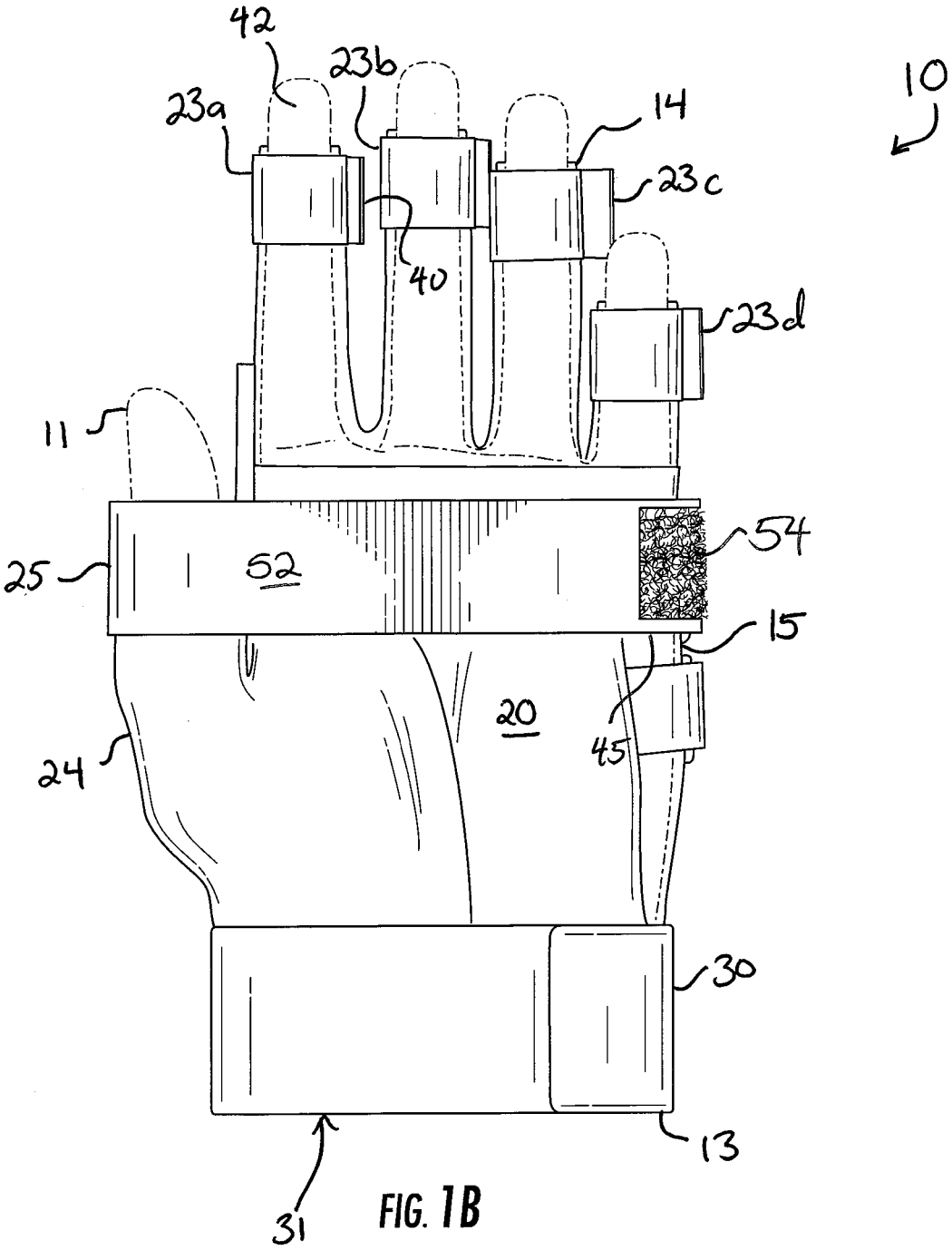

Reference now is made to the drawings, in which the same reference characters are used throughout the different figures to designate the same elements. FIG. 1 is a front elevation view of a basketball training glove 10, illustrated applied on a hand 11 of an athlete. The hand 11 is drawn in dot-dash broken line and is shown only as an example of how the glove 10 is worn. Further, the glove 10 shown is a left glove, though one having ordinary skill in the art will readily appreciate that a glove constructed and arranged according to the description below could be made as a right hand glove without substantive changes to the construction of the glove 10. The glove 10 includes a glove body 12 including a bottom 13, a top 14, and a middle 15 disposed therebetween. The glove body 12 further includes a palmar panel 20, shown in FIG. 1B, extending between the bottom 13 and the middle 14, and a dorsal panel 21, extending between the bottom 13 and the top 14. The glove body 12 is preferably formed from two overlying pieces of elastic fabric designed to stretch elastically and which are sewn together to move together.

Figure 3:
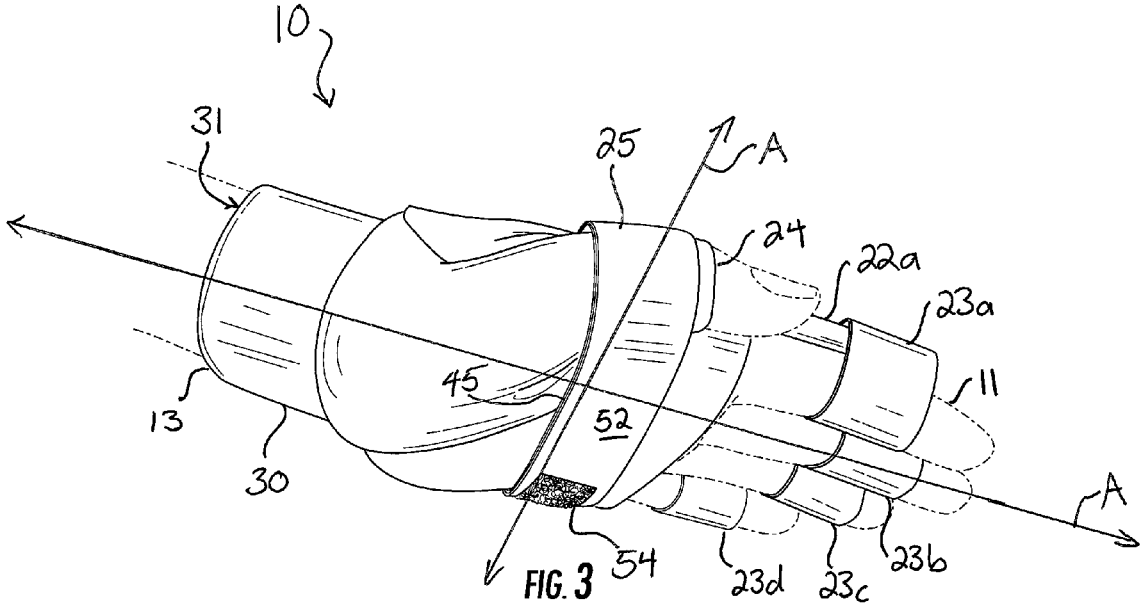
FIG. 3 is a rear perspective view of the glove of FIG. 1.

A medial plane A extends through the glove body 12 and is disposed intermediately between the palmar and dorsal panels 20 and 21. The medial plane A, represented in FIG. 3 by two intersecting double-arrowed lines each marked with the reference character A, is defined by and aligned through the glove body 12. In FIG. 1A, although not shown, the plane A is parallel to the page. In other FIGS., the plane A may be shown only by one of the double-arrowed lines, as the view permits.

Finger covers, each identified sequentially as finger covers 22*a*-22*d*, are formed integrally to the glove body 12 and extend from the middle 15 of the glove body 12 to the top 14. Finger straps 23*a*-23*d* are secured to each finger cover 22*a*-22*d*, respectively. A thumb stall 24 is formed integrally to the glove body 12 and extends from between the bottom 13 and the middle 15 outwardly away from the glove body 12. A thumb strap 25 is carried at the middle 15 of the glove body 12 and is wrapped around the glove body 12 and secured upon itself. Finally, a wrist strap 30 is carried at the bottom 13 of the glove 10 and is useful for adjusting the size of an opening 31 to the glove 10 to receive larger or smaller-sized wrists.

The finger covers 22*a*-22*d* correspond to the fingers of a hand. The finger cover 22*a* is an index finger cover, the finger cover 22*b* is a middle finger cover, the finger cover 22*c* is a ring finger cover, and the finger cover 22*d* is a pinky finger cover. The finger covers 22*a*-22*d* are identical in construction, and description of the construction will be made here only with respect to the finger cover 22*a*, with the understanding that one having ordinary skill in the art will readily appreciate that the finger covers 22*b*-22*d* are constructed in an identical fashion. Variations between the finger covers 22*a*-22*d* will be addressed herein. The finger cover 22*a* is a tongue of material extending to the top 14 from the middle 15 of the glove body 12. When worn, the finger cover 22*a* overlies only the dorsal side of the index finger, so that the underside, or palmar side, of the index finger is substantially uncovered. The finger cover 22*a* has a width between opposed sides 32 and 33, and such width is constant across the entire length of the finger cover 22*a*.

The finger cover 22*a* is elongate, rectangular, has a thin profile, and is constructed preferably from two pieces of fabric sewn together along the sides 32 and 33. Indeed, the finger cover 22*a* is formed integrally to the glove body 12 and the two pieces of fabric forming the glove body 12 are preferably the same two pieces of fabric forming the glove body 12.

Four elongate, rigid members 34*a*-34*d* are carried along the glove body 12. The rigid member 34*a* corresponds to the finger cover 22*a*, the rigid member 34*b* corresponds to the finger cover 22*b*, the rigid member 34*c* corresponds to the finger cover 22*c*, and the rigid member 34*d* corresponds to the finger cover 22*d*. Each rigid member 34*a*-34*d* is shown in broken line in the various FIGS. Continuing the description of the construction of the finger cover 22*a*, the rigid member 34*d* extends from proximate to the bottom 13, just above the wrist strap 30, along the finger cover 22*a* to the top 14. The rigid member 34*a* is preferably interposed between the two pieces of fabric forming the finger cover 22*a* and is fixed in location with stitching around an entire perimeter of the rigid member 34*a*. The rigid member 34*a* is aligned with the plane A and prevents movement of the finger cover 22*a* out of alignment with the plane A. The rigid member 34*a* has a proximal end 35, an opposed distal end 36, and an intermediate section 37 therebetween. The proximal end 35 of the rigid member 34*a* is disposed just above the wrist strap 30 proximate to the bottom 13 of the glove body 12, and the distal end 36 is disposed in the finger cover 22*a* proximate to the top 14 of the glove body 12 at that finger cover 22*a*. Between the proximal end 35 and the intermediate section 37, the rigid member 34*a* is disposed within the dorsal panel 21 of the glove body 12, and between the intermediate section 37 and the distal end 36, the rigid member 34*a* is disposed within the finger cover 22*a*. Thus, the intermediate section 37 of the rigid member 34*a* is located generally at a location at which the finger cover 22*a* is joined to the glove body 12.

The finger strap 23*a* overlies the finger cover 22*a* and the rigid member 34*a*. The rigid member 34*a* is constructed from a material or combination of materials possessing stiff, rigid, resilient material characteristics, such as metal, wood, or high-strength plastic. The rigid member 34*a* resists bending or yielding away from the plane A, resists movement into or out of the page (as depicted in FIGS. 1A and 1B), and resists movement laterally in the page parallel to the plane A. Some slight lateral movement is achieved with side-to-side movement of the fingers, and is permitted to the extent that stitching around the rigid member 34*a* is loose. The finger strap 23*a* has a free end 40 (shown in FIG. 1B), a fixed end, and a free length 41. The fixed end is secured to the finger cover 22*a* at the top 14, and the free length 41 extends from the fixed end to the free end 40 around an index finger of a hand applied to the glove 10. The free length 41 is wrapped around the finger cover 22*a* and the index finger over which the finger cover 22*a* extends. The free end 40 carries a hook element and is secured against the free length 41 which carries a complemental loop element, thus allowing the free end 40 to be repeatedly engaged and disengaged. The finger strap 23*a* is wrapped around the finger cover 22*a* in a clockwise fashion when the glove 10 is viewed from the top 14.

As seen in FIG. 1B, when positioned according to the teachings herein, the finger strap 23*a* wraps around the index finger and is spaced below the pad 42 of the index finger. The finger strap 23*a* is thus disposed between the first and second knuckles of the index finger. The finger strap 23*a* prevents flexion of the index finger by preventing flexion of the finger cover 22*a* carrying the rigid member 34*a*.

The finger covers 22*b*-22*d* are identical in construction to the finger cover 22*a*, but different in location. As shown clearly in FIGS. 1A and 1B, the finger cover 22*a* is proximate to the thumb stall 24. The finger cover 22*b* is proximate to the finger cover 22*a*, the finger cover 22*c* is proximate to the finger cover 22*b*, and the finger cover 22*d* is proximate to the finger cover 22*c* and is furthest from the thumb stall 24. Each of the finger covers 22*b*-22*d* include finger straps 23*b*-23*d* structured and attached to the respective finger covers 22*b*-22*d* in an identical fashion to the finger strap 23*a* with respect to the finger cover 22*a*.

The thumb stall 24 is moveable between a free position and a shooting position. In the free position of the thumb stall 24, the thumb stall 24 is freely moveable and can be manipulated by motion of a thumb installed in the thumb stall 24. In the free position of the thumb stall 24, the thumb stall 24 is out of alignment with the plane A. The shooting position taught by this disclosure is a preferred position of the thumb stall 24 and holds the thumb in a preferred position with respect to the fingers, the wrist, and the ball held against the guide hand. In the shooting position, as shown in FIGS. 1A, 1B, 3, and 4A-4C, the thumb stall 24 is retracted away from the palmar panel 20 and into alignment with the plane A, thereby disposing the palmar side of the thumb stall 24 toward the finger covers 22*a*-22*d*, and directing one side of the thumb toward the basketball. The shooting position places the thumb stall 24 toward the finger cover 22*a* and toward the dorsal panel 21.

Figure 2:
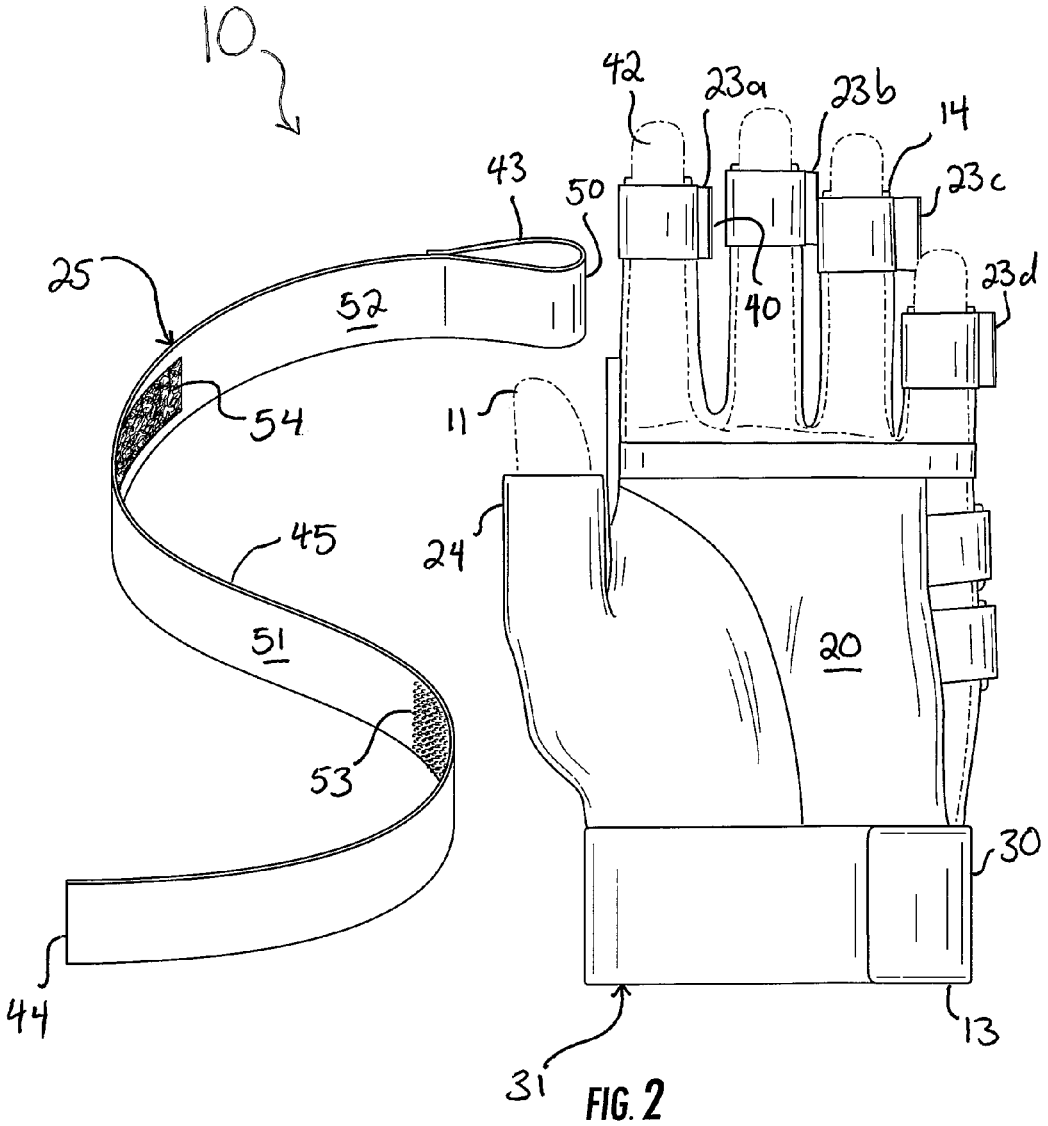
FIG. 2 is a rear elevation view of the glove of FIG. 1 showing a thumb strap.

The thumb strap 25 is uniquely useful for placing the thumb stall 24 in the shooting position thereof. When the thumb stall 24 is captured by the thumb strap 24, the thumb strap 25 maintains the thumb stall 24 in the shooting position thereof and prevents movement of the thumb stall 24 out of the shooting position. With reference now to FIG. 2, the thumb strap 25 is elongate and has a fixed end 43, a moveable or free end 44, and a free length 45 extending therebetween. The fixed end 43 is coupled to the thumb stall 24, and the free end 44 is free of the thumb stall 24 and able to be moved, placed, and replaced as desired. In the embodiment shown in FIG. 2, the fixed end 43 is formed with a flexible loop 50 sized to fit over the thumb stall 24 when a thumb is applied thereto. The loop 50 is snug fit onto the thumb stall 24 so that the thumb strap 25 is fixed on the thumb stall 24 and prevented from movement on the thumb stall 24, off of the thumb stall 24, or away from the thumb stall 24. In other embodiments, such as those shown in FIGS. 1A and 1B, the fixed end 43 is permanently coupled to the thumb stall 24 such that the loop 50 is formed integrally to the thumb stall 24, or, in other embodiments, the loop 50 is sewn over and onto the thumb stall 24. Because the fixed end 43 is attached to the glove body 12, the fixed end 43 is considered an extension of the glove body 12, as is the free end 44, which is attached to the fixed end 43 through the free length 45. Unlike other training gloves, the thumb strap 25 is wrapped entirely around the glove body 12 and encircles the glove body 12 to urge the thumb stall 24 away from the palmar panel 20 and into alignment with the plane A. The thumb stall 24 is positionable within and with respect to the thumb strap 25 so as to move and maintain the thumb stall 24 proximate to the finger cover 22*a* and toward the dorsal panel 21.

Still referring to FIGS. 1A-2, the thumb strap 25 has opposed inner and outer faces 51 and 52 carrying complemental engagement elements. The inner face 51, when wrapped around the glove body 12, is presented toward the glove body 12, and the outer face 52, when the thumb strap 25 is wrapped around the glove body 12, is presented away from the glove body 12. Hook engagement elements 53 are carried on the inner face 51 along the free length 45 proximate to the free end 44. Loop engagement elements 54 are carried on the outer face 52 along the free length 45 proximate to the fixed end 43. When wrapped around the glove body 12 according to the preferred and recommended technique, the thumb strap 25 extends first across the dorsal panel 21. The free length 45 of the thumb strap 25 extends from the fixed end 43 secured on the thumb stall 24 and across the dorsal panel 21, with the inner face 51 in contact with and along the dorsal panel 21. The free length 45 wraps around the glove body 12 from the dorsal panel 21 to the palmar panel 20 proximate to the finger cover 22*d*, and then extends across the palmar panel 20 to the thumb stall 24, as shown in FIG. 1B. Arranged in this way, the loop engagement elements 54 are disposed between the dorsal and palmar panels 21 and 20 proximate to the finger cover 22*d*, and the loop engagement elements 54 are directed away from the glove body 12 so as to be able to receive the complemental hook engagement elements 53. The free length 45 continues to wrap from the palmar panel 20 around the outside of the thumb stall 24 and back across the dorsal panel 21, over and along itself at the dorsal panel 21, as shown in FIG. 1A. The free length 45 is applied to and secured on itself; the hook members 53 on the inner face 51 are applied against the loop members 54 on the outer face 52 so that the thumb strap 25 forms a secured, fixed-length loop fastened snugly about the glove body 12. With the fixed end 43 of the thumb strap 25 coupled on the thumb stall 24 and the thumb strap 25 wrapped in a clockwise fashion around the glove body 12 (when the glove 10 is viewed from the top 14), the thumb stall 24 is maintained within the loop of the thumb strap 25 and is prevented from movement away from the plane A and the finger cover 22*a*.

In the embodiment described above, the inner face 51 carries the hook engagement elements 53 and the outer face 52 carries the loop engagement elements 54. One having ordinary skill in the art will readily appreciate that the positioning of the hook and loop engagement elements 53 and 54 may be reversed, or that the engagement elements may be replaced by similar engagement elements, such as snap fasteners, clasp fasteners, magnets, or the like. The glove body 12 is preferably constructed from a combination of fabric materials having an elastic characteristic so that the glove body 12 may be stretched slightly to fit hands of different sizes. The finger straps 23 and the thumb strap 25 are constructed from a material or combination of materials having low elasticity and relatively little flexibility, so that the finger straps 23 and thumb strap 25 can each be drawn and pulled tightly so as to tightly secure and bound the finger or thumb about which they are disposed, without relaxing over time as an effect of the material stretching.

Figure 4A:
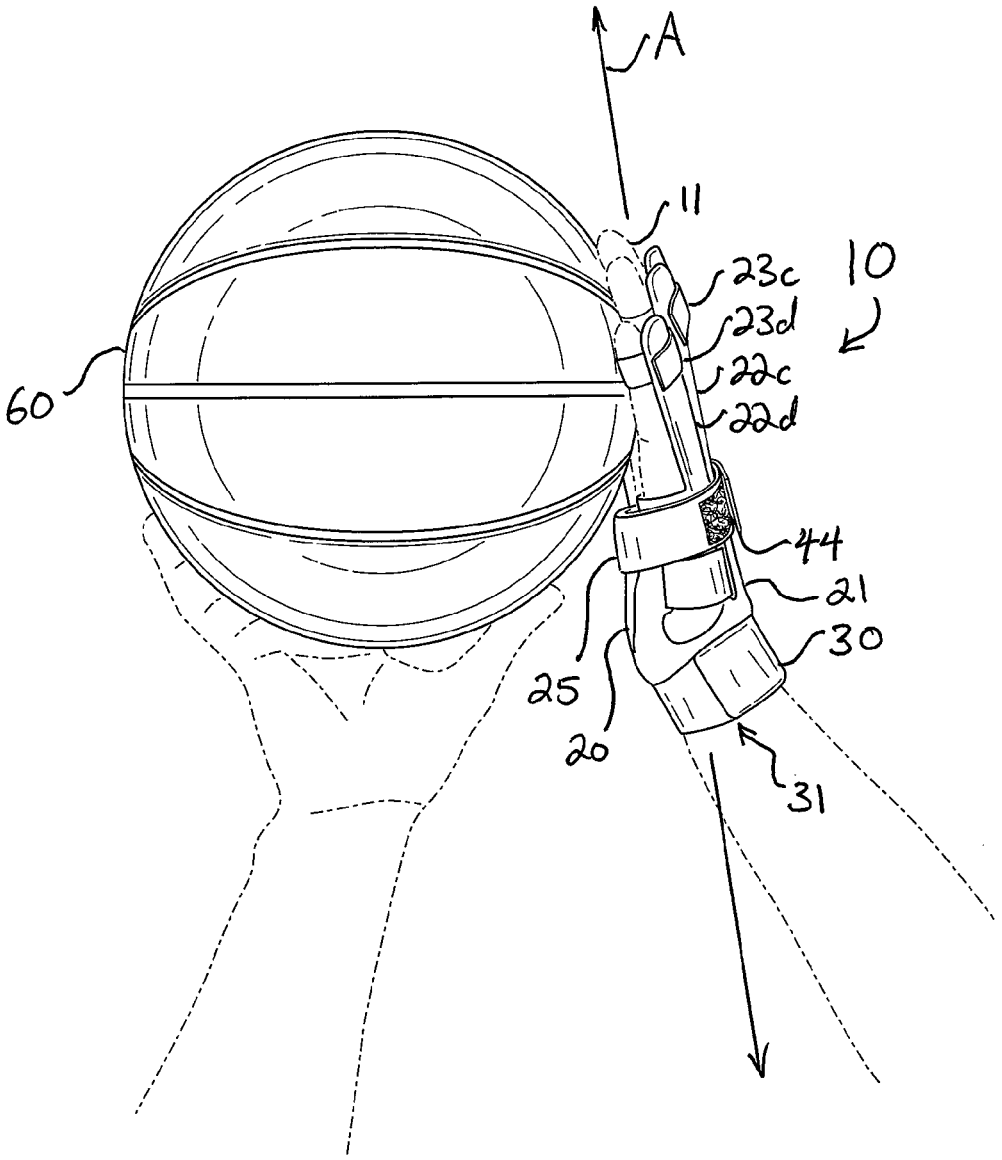
FIGS. 4A-4C illustrate the glove in use with a basketball during a shot.
Figure 4B:
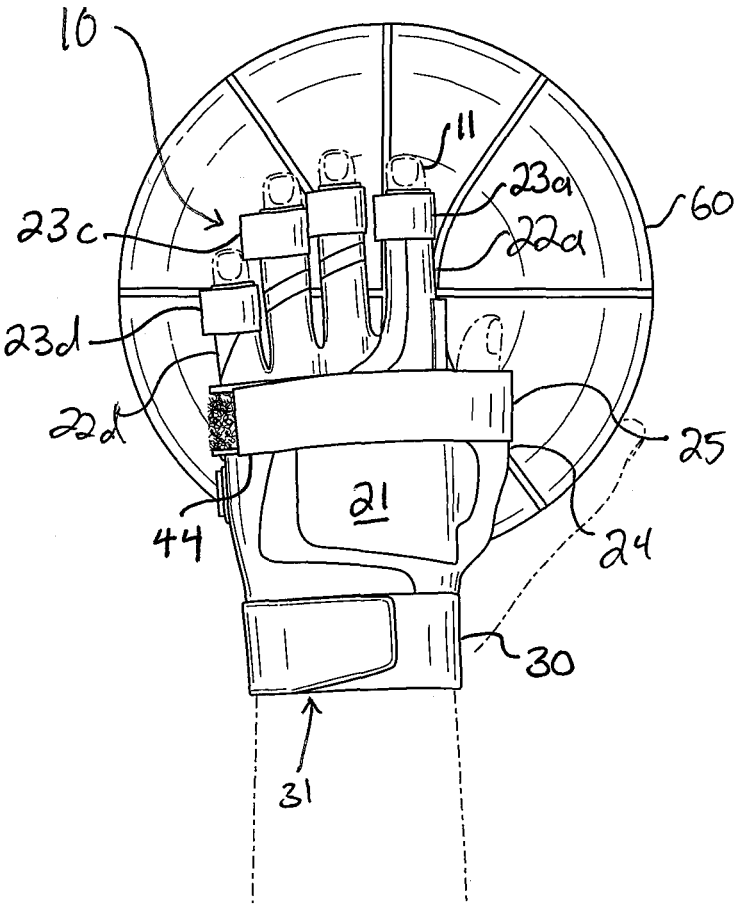
Figure 4C:
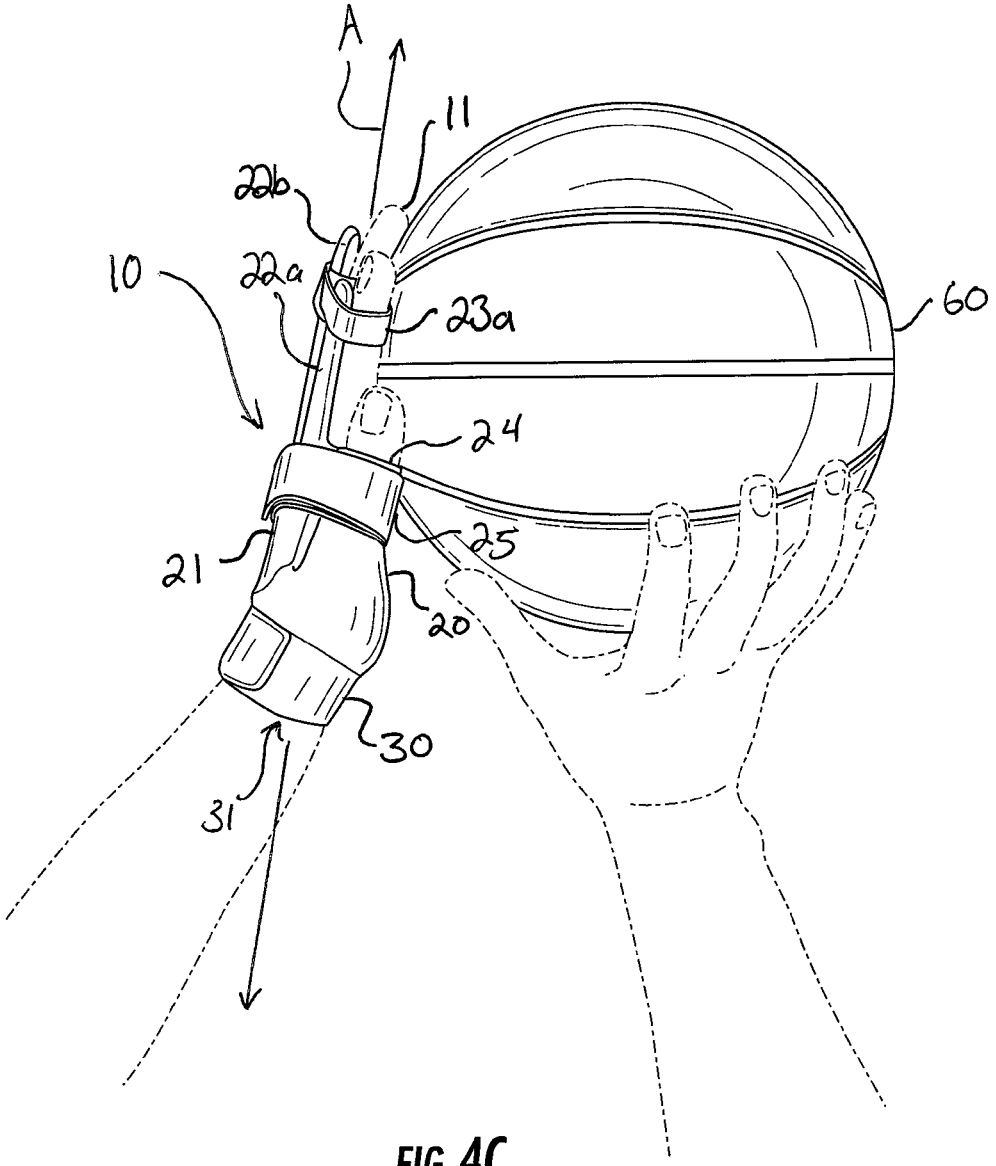

In operation, the glove 10 is useful for training an athlete how to properly support a basketball with the guide hand. FIGS. 4A-4C illustrate the glove 10 in use with a basketball 60. The basketball 60 is shown in solid line, while the hands are shown in broken line to minimize visual information on the page. As can be seen, the glove 10 is worn on the left hand 11, which here is the guide hand. The glove 10 is applied to the left hand 11 initially as one would don a typical glove. The opening 31 is presented toward the fingers of the hand 11, and the fingers are introduced through the opening 31. The fingers and thumb pass into an interior space defined between the palmar and dorsal panels 20 and 21, and the thumb is applied to the thumb stall 24. The fingers each are disposed under and in alignment with the finger covers 22. The finger straps 23*a*-23*d* are wrapped around and tightened over the respective finger covers 22*a*-22*d* in a clockwise fashion, so that the fingers are prevented moving out of the plane A. The thumb strap 25 is then applied. If the embodiment of the glove 10 is one in which the thumb strap 25 is removable from the glove body 12, the loop 50 of the thumb strap 25 is first placed over the thumb and the thumb stall 24. Then thumb strap 25 is wrapped around the dorsal panel 21 of the glove body 12, around the glove body 12 proximate to the finger cover 22*d*, around the palmar panel 20, around the thumb stall 24, and is fixed upon itself at the dorsal panel 21 by engaging the complemental hook and loop engagement elements 53 and 54 with each other. This clockwise wrapping of the thumb strap 25 serves to pull the thumb stall 24 away from the palmar panel 20, toward the dorsal panel 21, into alignment with the plane A, and toward the finger cover 22*a*. This causes the thumb to rotate so that the sides of the thumb are aligned with the palmar and dorsal panels 20 and 21, as can be seen in FIGS. 4B and 4C. Securing the thumb strap 25 not only secures the thumb stall 24 in position, but also binds the proximal ends 35 of the rigid members 34 so that the finger covers 22 cannot bend. The glove 10 is unique in that it solves common shooting problems without introducing new ones as other basketball training aids do: the glove 10 prevents thumbing of the basketball with the guide hand, prevent cradling of the basketball with the guide head, places the guide hand in the proper vertical alignment, and places the shooting hand directly under the basketball so as to emulate proper one-handed shooting technique. This is accomplished by the thumb strap 25 simultaneously drawing the thumb stall 24 back toward the dorsal panel 21 and securing the rigid members 34*a*-34*d* so that the finger covers 22*a*-22*d* cannot be bent.

The arrangement of the thumb strap 25 results in the hand being forced into a relatively flat position and prevents the hand from cupping or holding the basketball 60. Because such cupping is prevented, the pads at the tips of the fingers cannot touch the ball if the palm of the hand is touching the basketball 60. Likewise, the palm of the hand cannot touch the basketball 60 if the pads at the tips of the fingers are already touching the basketball 60. Instead, the hand is flat. When a basketball 60 is held by the hands of an athlete for shooting, the guide hand wearing the glove 10 cannot cup or cradle the basketball 60. Rather, the guide hand can only be placed against the side of the basketball 60. Further, only the pads at the tips of the fingers are capable of touching the basketball 60: the lower portion of the fingers cannot touch the basketball 60, and the palm of the hand (or the palmar panel 20 of the glove 10) cannot touch the basketball 60. Indeed, because the finger straps 23*a*-23*d* wrap around the fingers and are spaced below the pads of the fingers, were only portions of the fingers below the pads to touch the basketball 60, only fabric would touch the basketball 60 and the athlete would have less control of the basketball 60 and the basketball 60 could potentially slide out of his hands. In other words, when the basketball 60 is mishandled and the basketball 60 is positioned only against the portions of the fingers which are covered with the finger straps 23 (as opposed to being positioned against the finger pads), the basketball 60 will be in contact with smooth fabric and cannot be controlled. This acts as a disincentive to supporting the basketball 60 improperly. In this way, the glove 10 prevents the basketball 60 from being cupped because only the pads of the fingers are available to make non-sliding contact with the basketball. Similarly, the palm of the hand 11 is covered with the fabric of the palmar panel 20, and so if the basketball 60 is placed against the palm, the basketball will slide off. The glove 10 thus discourages an athlete from allowing the basketball 60 to touch any part of the hand 12 other than the pads of the fingers, because any other contact will result in a loss of control of the basketball 60.

By using the glove, the athlete is forced to shoot and power the ball with his shooting hand, and rely on his guide hand only stabilize the ball laterally. As can be seen in FIGS. 4A-4C, the glove 10 is being used with proper shooting technique: the shooting hand is directly under the basketball 60, with the fingers flexed and cradling the basketball 60, and the guide hand 11 is on the side of the basketball 60, directed vertically upward with the fingers straight and directed vertically upward. In this fashion, the guide hand 11 provides no support under the basketball 60 and instead fully supports the basketball 60 laterally. Use of the glove 10 thus forces the athlete to emulate proper one-handed shooting technique. Repeated use of the glove 10 exploits muscle-memory learned behavior, so that the athlete will begin to properly guide the basketball 60 with his guide hand 11 and shoot the ball with his shooting hand.

A preferred embodiment is fully and clearly described above so as to enable one having skill in the art to understand, make, and use the same. Those skilled in the art will recognize that modifications may be made to the described embodiment without departing from the spirit of the invention. To the extent that such modifications do not depart from the spirit of the invention, they are intended to be included within the scope thereof.

The invention claimed is:

1. A glove consisting of:

a glove body including a bottom, a top, a middle, finger covers extending from the middle to the top, a thumb stall, and a palmar panel and a dorsal panel each extending from the bottom to the middle;

a wrist strap carried on the bottom of the glove body;

a thumb strap carried on the thumb stall at the middle of the glove body, the thumb strap including a first end formed with a closed loop fit over the thumb stall, an opposed free second end, a first face extending from the first end to the second end and carrying an element of an engagement assembly, and an opposed second face extending from the first end to the second end and carrying a complemental element of the engagement assembly, wherein the element and complemental element of the engagement assembly are spaced apart from each other so that, when the thumb strap is wrapped around the glove body, the element and complemental elements of the engagement assembly are disposed and engage each other at the dorsal panel;

finger straps carried on the finger covers, the finger covers having only a dorsal side and no palmar side, such that the finger straps define an only palmar extension of the finger covers, wherein each finger strap is configured to be disposed, when the glove is worn, just below a pad of a finger; and a plurality of rigid elements, each carried and extending continuously from the dorsal panel along each of the finger covers;

wherein the glove body is constructed from a material having a smooth, non-grip fabric.

2. A glove consisting of:

a glove body including a bottom, a top, a middle, a thumb stall, and a palmar panel and a dorsal panel each extending from the bottom to the middle;

a plane defined by and aligned through the glove body and disposed intermediately between the palmar and dorsal panels;

finger covers extending from the middle of the glove body to the top of the glove body in alignment with the plane;

a wrist strap carried on the bottom of the glove body;

a thumb strap carried on the thumb stall at the middle of the glove body, the thumb strap including a first end formed with a closed loop fit over the thumb stall, an opposed free second end, a first face extending from the first end to the second end and carrying an element of an engagement assembly, and an opposed second face extending from the first end to the second end and carrying a complemental element of the engagement assembly, wherein the element and complemental element of the engagement assembly are spaced apart from each other so that, when the thumb strap is wrapped around the glove body, the element and complemental elements of the engagement assembly are disposed and engage each other at the dorsal panel;

finger straps carried on the finger covers, the finger covers having only a dorsal side and no palmar side, such that the finger straps define an only palmar extension of the finger covers, wherein each finger strap is configured to be disposed, when the glove is worn, just below a pad of a finger; and a plurality of rigid elements, each carried on and extending continuously from the dorsal panel along each of the finger covers parallel to the plane;

wherein the glove body is constructed from a material having a smooth, non-grip fabric.

3. A glove consisting of:

a glove body including a bottom, a top, a middle, a thumb stall including a dorsal side and a palmar side, and a palmar panel and a dorsal panel each extending from the bottom to the middle;

a plane defined by and aligned through the glove body and disposed intermediately between the palmar and dorsal panels;

finger covers extending from the middle of the glove body to the top of the glove body in alignment with the plane, the finger covers having only a dorsal side;

a wrist strap carried on the bottom of the glove body;

a thumb strap carried on the thumb stall, the thumb strap including a first end formed with a closed loop fit over the thumb stall, an opposed free second end, a first face extending from the first end to the second and carrying an element of an engagement assembly, and an opposed second face extending from the first end to the second end and carrying a complemental element of the engagement assembly, wherein the element and complemental element of the engagement assembly are spaced apart from each other so that, when the thumb strap is wrapped around the thumb stall and the glove body, the element and complemental elements of the engagement assembly are disposed and engage each other at the dorsal panel, thereby disposing the thumb stall away from the palmar panel and into alignment with the plane, with the palmar side of the thumb stall toward the finger covers and against a first of the finger covers, and with the thumb stall prevented from movement out of the plane and from movement away from the first of the finger covers;

finger straps carried on the finger covers defining an only palmar extension of the finger covers, wherein each finger strap is configured to be disposed, when the glove is worn, just below a pad of a finger; and a plurality of rigid elements, each carried on and extending continuously from the dorsal panel along each of the finger covers parallel to the plane;

wherein the glove body is constructed from a material having a smooth, non-grip fabric.

* * * * *